United States Patent [19]

Sando et al.

[11] 4,357,811

[45] Nov. 9, 1982

[54] CONTINUOUS PROCESSING APPARATUS FOR TREATMENT OF TUBULAR KNITTED FABRIC MATERIAL

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 207,426

[22] Filed: Nov. 17, 1980

[30] Foreign Application Priority Data

Nov. 21, 1979 [JP] Japan ..... 54-161604[U]
Jul. 15, 1980 [JP] Japan ..... 55-96509
Jul. 16, 1980 [JP] Japan ..... 55-97094

[51] Int. Cl.³ ..... D06B 3/12
[52] U.S. Cl. ..... 68/5 E; 68/9; 68/207
[58] Field of Search ..... 68/5 D, 5 E, 9, 207

[56] References Cited

U.S. PATENT DOCUMENTS 2,539,947 1/1951 De Klerk ..... 68/5 E X
4,055,970 11/1977 Sando et al. ..... 68/5 E

FOREIGN PATENT DOCUMENTS 2840932 3/1979 Fed. Rep. of Germany ..... 68/5 E

*Primary Examiner*—Philip R. Coe
*Attorney, Agent, or Firm*—Toren, McGeady and Stanger

[57] ABSTRACT

A continuous processing apparatus for a hygro-thermic treatment of a fabric material such as a tubular knitted fabric material capable of adequately applying a treating liquid to the fabric material within a high pressure steamer. The liquid to be supplied to the inside of the high pressure steamer is heated to prevent steam within the drum body of the steamer from becoming a drain and to enhance the effect of impregnating the fabric material with the liquid or the effect of preparatory washing. While the fabric material is conveyed within the steamer, it is kept in a suspended state without tension to let it have a good touch and bulkiness.

2 Claims, 1 Drawing Figure

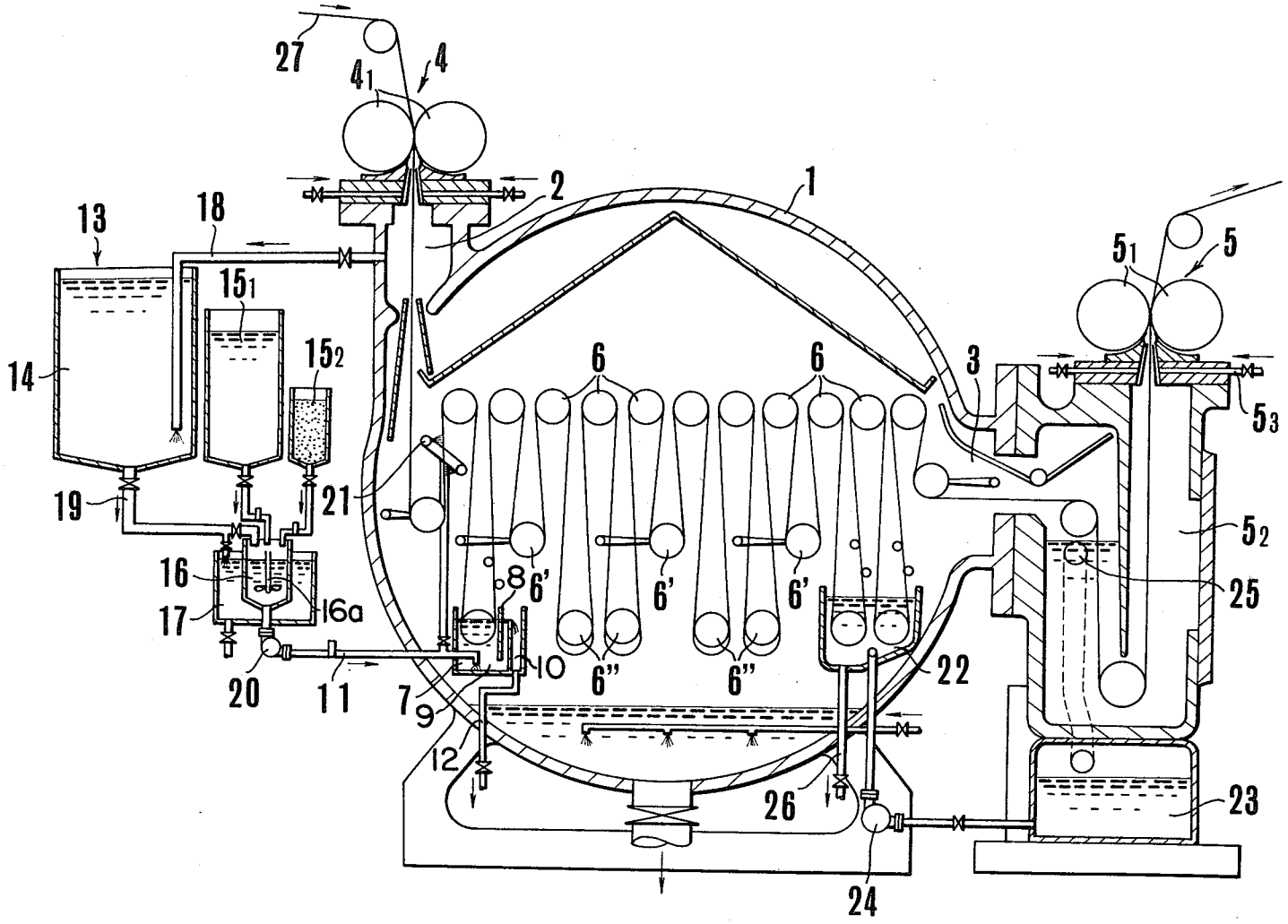
5
5₁
5₂
5₃
25
23
3
22
24
1
6
6'
6''
26
2
4
4₁
27
10
8
9
12
7
21
11
15₂
16a
20
15₁
18
16
17
13
19
14

CONTINUOUS PROCESSING APPARATUS FOR TREATMENT OF TUBULAR KNITTED FABRIC MATERIAL

BACKGROUND OF THE INVENTION

1. Field of the Invention:

This invention relates to a continuous processing apparatus which is capable of effectively performing a preparatory treatment or a dyeing treatment on a fabric material such as a tubular knitted fabric material through a hygro-thermic treatment carried out under high humid heat.

2. Description of the Prior Art:

In the conventional method for carrying out a preparatory treatment or a dyeing treatment in industrial production of a fabric material such as a tubular knitted material, the fabric material to be dyed, for example, has been passed through a dye solution tank to have a dye applied thereto and then subjected to a hygro-thermic treatment intermittently carried out for color development within a steamer, i.e. in a batch. In accordance with the conventional dyeing method, therefore, it has been impossible to carry out a continuous dyeing process. Hence, heat energy has been washed; the dyeing of one batch has varied from another; besides, in cases where the dyeing process is carried out at a temperature less than 100° C., the dye has taken a lengthy period of time before it is fixed to the fabric material.

In view of these shortcomings of the conventional method, therefore, the present inventors have long conducted studies for shortening the length of time required for dye fixing or for a preparatory treatment to make possible a high speed dye fixing or a high speed preparatory treatment. As a result of these studies, they have successfully developed a high pressure steamer which is capable of carrying out the dyeing or preparatory treatment of a fabric material not only in a matter of seconds but also in a continuous manner. Some installations of this high pressure steamer are now in use. This high pressure steamer is arranged such that the inside of a drum body of the steamer is kept at a high degree of pressure while there is provided a pair of seal rolls which are in pressed contact with each other and are arranged to permit a tubular knitted fabric material to be continuously supplied to the inside of the steamer. This arrangement necessitates the supply of the tubular knitted fabric material through the pair of seal rolls pressed against each other. Therefore, the tubular knitted fabric material which, for example, has been impregnated with a treating liquid outside of the drum body of the steamer has the liquid squeezed therefrom by the seal rolls. Therefore, the fabric material becomes impregnated with insufficient quantity of the liquid. To solve this problem, there have been proposed many methods and apparatuses in which the fabric material supplied to the inside of the drum body of a steamer is arranged to be impregnated with a desired liquid there by a liquid containing tank or a shower means provided within the drum body. Normally, the inside of the drum body of a high pressure steamer is arranged to keep humid heat of high temperature of about 150° C. while the temperature of the liquid to be supplied to the inside of the steamer is at normal temperature measuring about 20° C. Thus, there is a considerable temperature difference between the liquid temperature and the inside temperature of the steamer drum body. When the inside of the steamer drum body having the high humid heat is supplied with a liquid of lower temperature, the steam within the high pressure drum body is dulled by the cold liquid and the humidity of the inside of the steamer drum body becomes lower. Then, the concentration of the liquid varies. This makes it difficult to uniformly treat the tubular knitted fabric material. The present invention is directed to the solution of this problem.

SUMMARY OF THE INVENTION

It is an object of the present invention to provide a continuous processing apparatus for treatment of a tubular knitted fabric material which is capable of adequately applying a liquid to a tubular knitted fabric material within the drum body of the high pressure steamer.

It is another object of the invention to provide a continuous processing apparatus in which a liquid to be supplied to the inside of the drum body of the high pressure steamer is heated to prevent the steam from becoming a drain within the steamer drum body and to enhance the effect of having the tubular knitted fabric material impregnated with the liquid or to enhance the effect of preparatory washing.

It is a further object of the invention to provide a continuous processing apparatus in which a tubular knitted fabric material is guided and conveyed within a high pressure steamer drum body in a suspended state without any tension to bring forth a good touch and bulkiness of the fabric material.

These and further objects and advantages of the invention will be apparent from the following detailed description of an embodiment thereof taken in connection with the accompanying drawing.

BRIEF DESCRIPTION OF THE INVENTION

The accompanying drawing is an illustration of an apparatus as an embodiment of the present invention.

DETAILED DESCRIPTION OF PREFERRED EMBODIMENT:

In the embodiment of the invention which is shown in the accompanying drawing, there are provided a steamer drum body 1; an inlet 2 for a fabric material; and an outlet 3 for a fabric material. The fabric material inlet 2 is provided with an entrance seal mechanism 4 while the fabric material outlet 3 is provided with an exit seal mechanism 5. These seal mechanisms 4 and 5 are provided for the purpose of allowing the fabric material to enter and go out of the steamer drum body 1 while keeping the high humid heat within the steamer drum body 1. On the side of the entrance seal mechanism 4, there are arranged a pair of seal rubber rolls $4_1$ which are in pressed contact with each other. On the side of the exit seal mechanism, there are provided a pair of seal rubber rolls $5_1$ which are also in pressed contact with each other in the same manner as the seal mechanism on the side of the entrance side; a gradual cooling liquid tank $5_2$ the side view of which has an approximate J shape; and a liquid supply pipe $5_3$ which is arranged to supply the inside of the gradual cooling liquid tank from outside of the steamer with a gradual cooling liquid which also serves to wash the fabric material. Within the steamer drum body 1, there are provided guide rolls 6 which are arranged in the transverse direction to guide the fabric material. The guide rolls 6 include tension adjustment rolls 6' among them. Further, below the guide rolls 6, there are arranged auxiliary rolls 6'' in suitable positions. One of the guide rolls 6 is disposed within a liquid tank 7. The liquid tank 7 is divided by a partition wall 8 into a fabric material impregnating part 9 and an overflow part 10 with the guide roll 6 positioned within the impregnating part 9. Above the fabric material impregnating part 9, there is disposed a liquid supply pipe 11. Meanwhile, the overflow part 10 has a conduit 12 which is arranged to guide the liquid to the outside of the steamer drum body 1 connected to the bottom thereof. A reference numeral 13 indicates a liquid supply mechanism disposed outside of the steamer drum body 1. The liquid supply mechanism 13 includes a hot water tank 14; one or a plurality of undiluted solution tanks $\mathbf{15}_1$, $\mathbf{15}_2$, . . . which are, in this particular embodiment, a dye solution tank $\mathbf{15}_1$ and an auxiliary tank $\mathbf{15}_2$; a mixing tank 16 which is provided with a stirrer 16*a* or stirring and mixing undiluted solutions supplied in suitable quantities from the one or plurality of tanks $\mathbf{15}_1$ and $\mathbf{15}_2$; and a heat retaining tank 17 which has the mixing tank 16 disposed therein. Steam heat discharged from the fabric material inlet 2 of the steamer drum body 1 is introduced into the hot water tank 14 through a steam pipe 18 which is connected to the hot water tank 14 and is arranged to heat water within the tank 14 with the steam heat up to a temperature close to the temperature within the steamer drum body. A hot water supply pipe 19 is connected to the hot water tank 14 and is arranged to supply the hot water of the hot water tank either to the inside of the above stated heat retaining tank 17 or to the mixing tank 16. The solution contained within the mixing tank 16 is arranged to be supplied to the inside of the above stated liquid tank 7 by means of a pump 20. The mixing tank 16 operates in the following manner: The undiluted solution contained in the solution tank $\mathbf{15}_1$ and the auxiliary solution which are contained in the tank $\mathbf{15}_2$, for example, are supplied in suitable quantities by opening valves to the mixing tank 16 with stirring to obtain a dye solution of a desired color there. The dye solution thus obtained is sent out through the liquid supply pipe 11 by the operation of the pump 20 as desired. In changing the color or the properties of the dye solution, valves are closed. The solution within the mixing tank 16 is discharged therefrom. Then, a valve is opened to supply a washing liquid to the inside of the mixing tank 16. The inside of the mixing tank 16 is washed with this liquid by operating the stirrer 16*a*. After washing, the washing thus produced is discharged by pump operation. With the inside of the mixing tank 16 cleansed in this manner, the supply of the washing liquid is stopped by closing the valve. Following this, solutions contained in other tanks are selected as desired and are supplied in suitable quantities to the inside of the mixing tank 16 to obtain a desired solution. Blending of an undiluted solution and an auxiliary solution are carried out by opening and closing valves. A dye solution of a desired color and desired properties can be obtained by carrying out valve operations either electrically or through electrical signals from a computer.

As will be clearly understood from the foregoing description, with the valve opening and closing operations performed, the inside of the solution mixing tank 16 can be washed and then a solution of a different color and of a different kind can be obtained in the solution mixing tank 16. Thus, a small quantity of a solution of a predetermined blend can be continuously obtained. In other words, a desired amount of a preset blending ratio can be stored within the solution mixing tank 16 either with valve opening adjusted and kept at a predetermined degree or with valve opening and closing operations arranged to be effected at predetermined intervals by means of, for example, a pulse signal or the like. Accordingly, since the mixed solution prepared within the solution mixing tank 16 thus can be arranged to be completely consumed, the solution can be effectively prevented from being wasted. Further, the mixed solution within the solution mixing tank 16 is arranged to be gradually consumed and the tank 16 is arranged to be replenished with the mixed solution in proportion to the quantity to be consumed to prevent it from becoming empty. The mixed solution thus does not stay over a long period of time within the solution mixing tank. Therefore, there is no fear of degradation or discoloration of the mixed solution resulting from the lapse of a long period of time, so that the fabric material can be always supplied with a fresh mixed solution.

It is possible that the above stated liquid tank 7 is replaced with the use of a solution spray nozzle 21 or with a combination of the liquid tank 7 and the spray nozzle 21. A numeral 22 indicates a preparatory washing tank disposed close to the fabric material outlet 3 within the steamer drum body 1. Hot water of high temperature which has overflown the above stated gradual cooling tank $\mathbf{5}_2$ and is stored within a hot water reservoir 23 is gradually supplied to the inside of the preparatory washing tank 22 by the operation of a pump 24. For this purpose, the gradual cooling tank $\mathbf{5}_2$ is provided with an overflow opening 25. The preparatory washing tank 22 is provided with a water drain hole 26. A numeral 27 indicates a tubular knitted fabric material.

The embodiment being arranged as described in the foregoing, it operates in the following manner: The inside of the steamer drum body is arranged to continuously have high temperature and high pressure measuring, for example, 160° C. and 5.5 kg/cm$^2$. Then, water of normal temperature is gradually supplied to the inside of the gradual cooling tank $\mathbf{5}_2$ through the liquid supply pipe $\mathbf{5}_3$. With this arrangement completed, the operation of the embodiment is started. Heating is applied until the water within the hot water tank 14 is heated up to a degree of temperature about equal to the temperature within the steamer drum body 1 by heat discharged from the inside of the steamer drum body through the steam pipe 18. The hot water thus obtained is supplied to the inside of the heat retaining tank 17 to heat the mixed solution within the mixing tank 16 which is disposed inside of the heat retaining tank 17 up to a high degree of temperature close to 100° C. The pump 20 is operated either to supply this heated solution to the inside of the liquid tank 7 which is disposed within the steamer drum body 1 or to have this heated solution sprayed upon the fabric material 27 from the nozzle 21.

The water within the gradual cooling tank $\mathbf{5}_2$ is heated by the high temperature of the inside of the steamer drum body 1. However, since water of normal temperature is continuously supplied, the temperature of water in the vicinity of the seal rolls $\mathbf{5}_1$ is relatively low (about 50° C. in experiments) while temperature in the vicinity of the fabric material outlet 3 becomes high (130° C. in experiments). The hot water of this high temperature is arranged to overflow the overflow opening 25 and then to enter the hot water reservoir 23. After that, the heated water is gradually supplied by the pump 24 to the inside of the preparatory washing tank 22.

Since the liquid which is heated outside of the steamer drum body is arranged to be supplied to the liquid tank 7 or the preparatory washing tank 22 disposed within the steamer drum body as mentioned in the foregoing, the embodiment is capable of preventing the steam within the steamer drum body from becoming a drain. Therefore, the humid heat within the steamer drum body can be stably retained there and the concentration of the solution can be also stably kept unchanged, so that the treatment on the fabric material can be uniformly carried out.

Further, in accordance with the invention, the fabric material which is impregnated with the solution is subjected to the steaming process without having the impregnating solution squeezed out of the fabric material. Therefore, the treating process can be satisfactorily carried out with the fabric material being impregnated with a sufficient quantity of the solution. Further, since the fabric material is arranged to be conveyed within the steamer drum body in a suspended state there, no tension is applied to the fabric material while it is conveyed within the steamer drum body. Therefore, treatment can be advantageously carried out for the fabric material of the type that tends to elongate such as a knit fabric material.

The auxiliary rolls 6″ are provided for the purpose of preventing the fabric material from swaying or drooping and normally do not have the fabric material in contact with the circumferential faces of them while the fabric material is guided and conveyed within the steamer drum body. This normal conveying condition can be readily obtained by adjusting the speed at which the fabric material is conveyed.

Another advantage of the invention lies in that the liquids supplied to the liquid tank 7 and to the preparatory washing tank 22 are heated by thermal conduction of the heat within the steamer drum body while the heated water is obtained by utilizing the water discharged from the gradual cooling tank, so that the use of water and heat energy can be economized. Therefore, the hygro-thermic treatment apparatus of the invention has a great economic advantage.

What is claimed is:

1. A continuous processing apparatus for treatment of a tubular knit fabric material having a high pressure steamer drum body provided with a fabric material inlet and a fabric material outlet, said inlet being provided with an entrance seal mechanism arranged to continuously pass the fabric material into said drum body, said outlet being provided with an exit seal mechanism which has a gradual cooling tank, said apparatus comprising in combination:

a preparatory washing tank disposed within the steamer drum body;

a liquid supply passage arranged to gradually supply water of high temperature overflown from said gradual cooling tank to said preparatory washing tank;

a hot water tank which is disposed outside of said high pressure drum body and is provided with a suitable heating means;

a heat retaining tank arranged to have the hot water of said hot water tank introduced into the heat retaining tank;

a mixing tank disposed within said heat retaining tank, said mixing tank being provided with one or a plurality of undiluted solution supply pipes and a pipe for supplying the hot water contained in said hot water tank; and a solution supply passage for applying a heated solution contained in said mixing tank to the fabric material within said steamer drum body.

2. A continuous processing apparatus according to claim 1 further comprising an arrangement for mixing solutions and supplying a mixed solution, said arrangement including a plurality of solution tanks each of which is provided with a solution conduit extending from the bottom thereof; a valve provided on each of said conduits; said mixing tank for mixing solutions, said mixing tank being provided with a stirrer and having the fore end of each of said solution conduits connected thereto; and a pump for gradually sending out said mixed solution from the inside of said mixing tank.

* * * * *